US006425927B1

(12) United States Patent
Haupt-Stephan et al.

(10) Patent No.: US 6,425,927 B1
(45) Date of Patent: Jul. 30, 2002

(54) AQUEOUS COMPOSITION FOR FINISHING FIBROUS MATERIAL FOR A THERMAL TRANSFER PRINTING PROCESS

(75) Inventors: Renate Haupt-Stephan, Augsburg; Renate Linder, Egling, both of (DE)

(73) Assignee: Dr. Th. Boehme KG Chem. Fabrik GmbH & Co., Geretsried (DE)

( * ) Notice: Subject to any disclaimer, the term of this patent is extended or adjusted under 35 U.S.C. 154(b) by 0 days.

(21) Appl. No.: 09/558,312

(22) Filed: Apr. 25, 2000

(30) Foreign Application Priority Data

Apr. 26, 1999 (DE) ..... 199 18 890

(51) Int. Cl.[7] ..... D06P 5/00; B41M 3/12; B32B 27/14; B32B 5/16

(52) U.S. Cl. ..... 8/467; 428/195; 428/327; 427/148; 427/151

(58) Field of Search ..... 358/474, 27; 428/195, 428/323, 327; 427/148, 151; 503/208, 209; 8/467

(56) References Cited

U.S. PATENT DOCUMENTS 4,119,398 A 10/1978 Purser
5,811,369 A * 9/1998 Nagai et al. ..... 503/209
6,139,672 A * 10/2000 Sato et al. ..... 156/235

FOREIGN PATENT DOCUMENTS

| | | |
|---|---|---|
| CH | 564 637 | 8/1977 |
| DE | 24 36 783 | 2/1974 |
| DE | 24 58 660 | 6/1975 |
| DE | 28 40 438 | 3/1980 |
| DE | 222 052 | 5/1985 |
| DE | 41 26 096 | 2/1993 |
| EP | 0 036 965 | 4/1981 |
| EP | 0 209 029 | 5/1987 |

* cited by examiner

*Primary Examiner*—Yogendra N. Gupta
*Assistant Examiner*—Derrick G. Hamlin
(74) *Attorney, Agent, or Firm*—Reed Smith LLP

(57) ABSTRACT

An aqueous composition is disclosed for finishing fibrous material for a thermal transfer printing process comprising a) 0.5 to 2.5 percent by weight of a synthetic resin precondensate, b) 10 to 30 percent by weight of a thermoplastic plastic with reactive groups, c) 0.1 to 1.0 percent by weight of an inorganic salt with an acidic reaction, d) 0.2 to 2.0 percent by weight of a softening agent, and e) 0.05 to 0.5 percent by weight of an emulsifier.

The disclosure is further directed to the use of the composition for a thermal transfer printing process and a thermal printing process.

11 Claims, No Drawings

AQUEOUS COMPOSITION FOR FINISHING FIBROUS MATERIAL FOR A THERMAL TRANSFER PRINTING PROCESS

BACKGROUND OF THE INVENTION a) Field of the Invention

The invention is directed to an aqueous composition for finishing fibrous material for a thermal transfer printing process, the use of the composition therefor, and a thermal transfer printing process.

b) Description of the Related Art

It is generally known to dye synthetic fibers, e.g., polyester fibers, with disperse dyes. However, disperse dyes are only poorly soluble in water. For dyeing, the ground disperse dyes are dispersed in water. They penetrate into the synthetic fibers by diffusion and form a "fixed solution" which provides colored fibers with excellent resistance to laundering in water because of the poor solubility.

In a thermal transfer printing process, the disperse dye is applied first to a carrier, e.g., paper with a special coating, by means of a printing paste. By pressing together with the textile material to be imprinted and by heating, the disperse dye on the carrier is sublimated off the carrier and applied to the textile material. The high temperature used in this process promotes diffusion of the dye into the fibers of the textile material. This transfer of dye to the textile material is usually carried out at a temperature between 200 and 250° C. within a few seconds.

It is a prerequisite of thermal transfer printing that the disperse dye can diffuse into the fibers. However, this is not the case with natural fibers such as cotton or wool or with regenerated cellulose fibers. These fibers must first be suitably finished.

For this reason, there have been numerous attempts to provide suitable finishes for fibers which overcome the above-mentioned disadvantage.

For example, the German Patent 41 26 096 discloses a process for printing on substrates by means of transfer printing methods in which a resin-free transparent varnish or lacquer is applied to and dried on the natural fibers to be imprinted, wherein this lacquer can absorb and fix the sublimable dyestuffs in the subsequent thermal transfer printing process. As defined in Rompp Chemie-Lexikon, 1990, page 2424, lacquers are substances in liquid or powder form which are applied in thin coats to objects and which, as a result of chemical reaction and/or physical change, form a solid film which adheres to the objects. However, formation of films results in an unwanted reduction in air permeability and impaired breathing properties as well as in a relatively hard feel of the textile material.

Further, it is known to generate a duroplast in natural fiber materials by treating them with synthetic resins, wherein this duroplast is fixed so as to be wash-resistant and can absorb the disperse dyes. For example, the Swiss Patent 564 637 describes a process for simultaneously generating wash-fast fixed dyeing or printing based on the sublimation transfer method and high-grade finishing on textile fabrics formed entirely or partially of cellulose fibers, in which process the textile material is first treated with an aqueous solution of a crosslinking agent for the cellulose and, after pre-drying, is dyed or imprinted according to the transfer printing method. In so doing, the cellulose fibers are crosslinked during and/or after the transfer printing in the presence of a catalyst by application of heat and the dyes are accordingly fixed in the fibers so as to be wash-fast. While this treatment achieves the goal of dye affinity or power to absorb dye, it leads to an unwanted stiffening and harder feel of the textile material when a sufficient amount of crosslinking agent is applied for the transfer printing.

OBJECT AND SUMMARY OF THE INVENTION

Therefore, it is the primary object of the present invention to provide a composition for finishing fibrous material for a thermal transfer printing process which does not reduce air permeability or breathing of the fibrous material in an unwanted manner after printing and which provides the fibrous material with a pleasant, soft feel.

According to the invention, this is achieved by an aqueous composition for finishing fibrous material for a thermal transfer printing process comprising a) 0.5 to 2.5 percent by weight of a synthetic resin precondensate, b) 10 to 30 percent by weight of a thermoplastic plastic with reactive groups, c) 0.1 to 1.0 percent by weight of an inorganic salt with an acidic reaction, d) 0.2 to 2.0 percent by weight of a softening agent, and e) 0.05 to 0.5 percent by weight of an emulsifier, wherein the indicated amounts are in relation to the composition.

DETAILED DESCRIPTION OF THE INVENTION AND EXAMPLES THEREOF

By the expression "aqueous composition" is meant that it contains, in addition to the aforementioned components a) to e) and possibly other conventional components, water for making up to 100 percent by weight, i.e., the remainder is water. These components can be present in an amount of up to 5 percent by weight in relation to the composition.

The composition according to the invention has, as component a), a synthetic resin precondensate in the above-indicated amount. The treatment of cellulose fibers with synthetic resin precondensates (crosslinkers) is a process which is generally known in the textiles field and is extensively described in technical literature pertaining to textiles; for example, reference is had to H. Tovey, Textile Research Journal 31, pages 185 to 237 (1961), H. Rath. Zeitschrift f ür die gesamte Textilindustrie 69, pages 542 to 548 and pages 631 to 635 (1967), and the Swiss patent cited above.

The synthetic resin precondensates can be monomeric compounds which can contain two or more reactive groups which can react, on the one hand, with cellulose, especially the OH groups of cellulose, and on the other hand with the reactive groups of other synthetic resin precondensate molecules accompanied by formation of a covalent bond. Accordingly, the molecules of the synthetic resin precondensate can react with each other and be crosslinked with the cellulose. Examples of reactive groups are carbonyl, carboxyl and methylol groups.

Examples of synthetic resin precondensates are acetals, e.g., reaction products of formaldehyde and diethylene glycol, dimethylol monocarbamates, e.g., dimethylol methyl carbamate, dimethylol urea, dihydroxyethylene urea, propylene urea and derivatives thereof, triazones such as dimethylol-5-methoxyethyl-1,3,5-triazinon-2, methylol melamine compounds such as tetramethylol melamine or water-soluble etherified methylol melamine compounds, hexamethylene diethylene urea and glyoxal and derivatives thereof.

The synthetic resin precondensate can also have reactive groups which are different from each other.

The synthetic resin precondensate is preferably a compound containing at least two methylol groups (—$CH_2$—OH) which are advantageously bonded to N-atoms, wherein the N-atoms can be different or can be the same N-atom. In this connection, it is advantageous when the N-atom neighbors on a carbonyl group. Examples of such N-methylol compounds are dimethylol ethylene urea and compounds derived therefrom. The H-atom of the OH group of the methylol group can be substituted by an alkyl radical, e.g., a $C_1$–$C_4$ alkyl radical. If desired, the H-atoms of all or only of some of the OH groups of the methylol groups can be replaced by alkyl radicals.

Examples of compounds derived from dimethylol ethylene urea are those having the following formula:

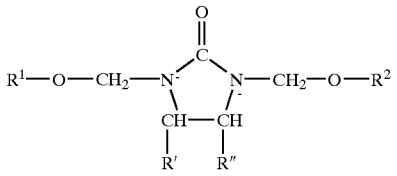

where R' and R" are identical or different and stand for H and OH, and $R^1$ and $R^2$ are identical or different and stand for H and $C_1$–$C_4$ alkyl. An example of a compound having the above formula which is derived from dimethylolethylene urea is dimethyloldihydroxyethylene urea.

These compounds have the advantage that only a very slight formaldehyde emission was determined when they were applied to the fibrous material and during the subsequent reaction of the synthetic resin precondensate molecules with one another, with the thermoplastic plastic and with cellulose. This is advantageous in view of the toxicologic disadvantages of formaldehyde. Further, the compounds having one of the alkyl radicals mentioned above have a very good shelf life, so that the compositions according to the invention can be stored over long periods of time.

The composition according to the invention can also contain several, e.g., two or three, synthetic resin precondensates that differ from one another.

The composition according to the invention contains a thermoplastic plastic with reactive groups as component b). Within the meaning of the present invention, by the expression "thermoplastic plastic" is meant thermoplastics of any type. They can be homopolymers or copolymers. The copolymers can be block copolymers or random copolymers. Examples of monomers suitable for producing the thermoplastic plastic are olefins such as ethylene, vinyl acetate, (meth)acrylic acid and esters thereof such as butyl acrylate.

The reactive groups contained in the thermoplastic plastic are advantageously those that can react with the reactive groups and/or OH groups of cellulose described in connection with the synthetic resin precondensates, so that a crosslinking of the thermoplastic plastic with the cellulose and/or with the synthetic resin precondensate can be achieved. Examples are the carboxyl group and the methylol group, especially the methylol groups bonded to an N-atom, wherein it is advantageous when the N-atom neighbors on a carbonyl group. Such groups are contained, e.g., in (meth) acrylic acid and in N-methylolacrylamide.

Such reactive groups can be introduced into the thermoplastic plastic by using monomers for its production (polymerization of monomers) which have these reactive groups, e.g., the above-mentioned N-methylolacrylamide and/or (meth)acrylic acid. The amount of monomers carrying reactive groups contained in the thermoplastic plastic is 1 to 10 percent by weight, particularly about 5 percent by weight, in relation to the thermoplastic plastic. An example of a thermoplastic plastic is a copolymer of ethylene and vinyl acetate (20:80 parts by weight) containing 5 percent by weight methylolacrylamide. Another example of this is a copolymer of vinyl acetate with butyl acrylate (1:1), containing 2.5 percent by weight of acrylic acid in relation to the thermoplastic plastic.

The thermoplastic plastic can have a plurality of different reactive groups. Further, the composition according to the invention can contain a plurality of, e.g., two, thermoplastic plastics which differ from one another and which, if desired, can carry different reactive groups. When two thermoplastic plastics differing from each other are used in the composition according to the invention, their ratio can be about 1:1.

An inorganic salt with an acidic reaction is contained in the composition according to the invention as component c). It serves as a catalyst for the crosslinking of components a) and b) with one another and with the cellulose. Examples of such salts are diammonium sulfate, zinc nitrate, zinc chloride, magnesium nitrate and, in particular, magnesium chloride. The latter salt represents a particularly gentle system and fewer losses will be sustained with respect to the breaking strength of the fibrous material.

Surprisingly, it has been found that no film formation was observed on the fibrous material which was treated with the composition according to the invention and subjected to a thermal transfer printing process; therefore, the air permeability and breathing behavior of the treated fibrous material was excellent. It is assumed—but not mandatory—that the artificial resin precondensates penetrate into the interior of the fibers. These precondensates react under condensation conditions, for example, 140° C. to 160° C. for 2 to 5 minutes, with, among others, the hydroxyl groups of cellulose accompanied by crosslinking. Accordingly, no film is formed which can negatively influence the passage of air through the textile material. The cellulose crosslinking achieved with artificial resin precondensates further reduces the tendency of the fibrous material to crease or wrinkle. By means of the thermoplastic plastics with reactive groups contained in the composition according to the invention, the brittleness of the natural fibers is kept low, a good crease-resistant effect is observed, and the swelling of the cellulose is kept low.

The composition according to the invention contains 0.2 to 2.0 percent by weight of a softening agent or a mixture of softening agents as component d). By "softening agent" is meant any type of compound providing the fibrous material with a soft feel. Examples of such compounds are hydrophobic compounds, preferably waxes, especially polyethylene waxes, and silicone oils, especially those based on polydimethylsiloxane or mixtures thereof. When the composition according to the invention contains a mixture of wax and silicone oil, the amount of wax can be between 0.1 and 1.0 percent by weight and that of silicone oil can also be 0.1 to 1.0 percent by weight, in relation to the composition in each instance. The combination of wax and silicone oil imparts an excellent feel to the fibrous material in a particularly advantageous manner, but at the same time does not negatively affect the fastness of the print. The aforementioned combination also has positive advantages with respect to the film-forming properties of the thermoplastic plastics.

The composition according to the invention contains 0.05 to 0.5 percent by weight of an emulsifier. This can be one or more nonionic emulsifiers, e.g., compounds based on ethoxylated fatty alcohols, ethoxylated fatty amines and mixtures thereof. The composition according to the invention is maintained stable by the emulsifier and the application of the composition to the fiber material is improved, especially by pad finishing.

Surprisingly, it was found further that by adding softeners emulsified in water not only was a soft, pleasant feel of the finished fibrous material achieved, but the wash fastness of the plastic intercalation and accordingly the anchoring of the disperse dyestuff was benefited by these hydrophobic components.

By adding softening agents and through extensive use of soft, reactive thermoplastics, the fibrous material prepared for the thermal transfer printing is given a pleasantly soft feel which it also retains after thermal transfer printing. Yet, there is no evidence of the brittleness which normally accompanies high-grade finishing with plastic resin precondensates and which is associated with a relatively hard feel. Further, it is possible by means of this combination to maintain low usage of plastic resin precondensate and, by extensive use of soft plastic dispersions, to apply sufficient substance with affinity to disperse dyestuff to enable thermal transfer printing. An adequate crease-resistant effect is achieved in spite of this. Good wash fastness of the applied printing is achieved by means of crosslinking with the synthetic resin precondensate. This wash fastness is further improved by the addition of the completely hydrophobic fiber softener.

The composition according to the invention can be used for finishing fibrous material for a thermal transfer printing process. Methods of applying the compositions according to the invention to fibrous material and devices required for this purpose are known to the person skilled in the art. For example, the aqueous composition can be applied to the fibrous material by means of pad finishing. The composition according to the invention with the above-mentioned components a) to e) can be applied to the fibrous material in one step, that is, all at once, enabling a simple, fast and economical application of components a) to e) to the fibrous material.

By "fibrous material" is meant any kind of fibers and materials having fibers. The latter can be textile fabrics made from fibers. The material from which the fibers or the textile fabrics are produced can be made of cellulose or can contain cellulose, where by "cellulose" is also meant chemically and/or physically modified cellulose. Examples of fibers are natural fibers, e.g., cotton or wool, and regenerated cellulose fibers.

As was already stated above, the composition according to the invention is applied to fibrous material. The amount of composition according to the invention is advantageously selected in such a way that it can be completely absorbed by the fibrous material, i.e., absorption is 100%.

After applying the composition according to the invention to the fibrous material, drying can be carried out, wherein the water can be substantially completely removed. In this connection, by "substantially" is meant that some water may still remain. This is usually carried out at temperatures of 100° C. or more (at normal pressure). However, the drying temperature should not exceed 140° C., since a condensation of the synthetic resin precondensate, as the case may be with the thermoplastic plastic, can take place already at these temperatures. The drying temperature is about 110° C., for example. The drying period depends on how much residual water remains in the fibrous material after drying. If the residual water is low, the drying process is carried out over a longer period.

In this drying step, there is not yet any condensation of the synthetic resin; treatment at 140° C. for at least 2 minutes is required for this purpose.

The fibrous material treated in this way can then be used in a conventional thermal transfer printing process. In this process, a disperse dyestuff, for example, particularly a sublimable disperse dyestuff, is applied to a carrier, e.g., a specially coated paper, by means of a printing paste. By pressing together and heating with the fibrous material which is to be imprinted and which is treated with the composition according to the invention, the disperse dye present on the carrier is transferred from the latter to the fibrous material. If the disperse dye or dyes is/are present on the carrier in the form of a pattern, this pattern is transferred to the fibrous material. The transfer can be effected at temperatures of 200 to 250° C. in a few seconds to several minutes, e.g., 10 second to 2 minutes. In so doing, a crosslinking of the synthetic resin precondensate, of the thermoplastic plastic, and of the cellulose is achieved.

The following example illustrates the present invention:

EXAMPLE

Thermal Transfer Printing Process using a Composition According to the Invention Liquor Formulation

- 200 g of an aqueous dispersion of a copolymer of ethylene and polyvinyl acetate (20:80 parts by weight), containing 5 percent by weight of methylolacrylamide, 52-% in relation to the solids;
- 200 g of an aqueous dispersion of a copolymer of vinyl acetate with butyl acrylate (1:1), containing 2.5 percent by weight of acrylic acid, 50-% in relation to the solids;
- 20 g of a 75-% aqueous solution of a synthetic resin precondensate based on dimethylol dihydroxyethylene urea;
- 6 g of magnesium chloride;
- 20 g of a textile softener containing, in aqueous emulsion, 11.5% polydimethylsiloxane, 8.8% polyethylene wax, and 4% nonionic emulsifiers based on ethoxylated fatty alcohols and ethoxylated fatty amines.

In this liquor formulation, the indicated amounts are supplemented by cold, demineralized water to make 1 liter and applied to the cotton fabric with a pad. Liquor absorption is 100%.

After pad finishing, drying is carried out at 110° C. In so doing, the water evaporates, but the synthetic resin precondensate does not yet react. At least 2 minutes at 140° C. are necessary for the condensation of a synthetic resin.

The thermal transfer printing was carried out at 210° C. with a contact time of 30 seconds using a 100% cotton fibrous material and a commercially available paper carrier with disperse dyestuffs (made by Transfertex GmbH & Co. Thermodruck KG). The complete crosslinking of the synthetic resin precondensate was also achieved in this thermal treatment.

The obtained printing had good wash fastness. The cotton fabric exhibited the usual easy-care properties, i.e., improved shrinkage properties and creasing tendency. It had a pleasantly soft feel.

While the foregoing description and drawings represent the preferred embodiments of the present invention, it will be obvious to those skilled in the art that various changes and modifications may be made therein without departing from the true spirit and scope of the present invention.

What is claimed is:

1. Aqueous composition for finishing fibrous material for a thermal transfer printing process comprising a) 0.5 to 2.5 percent by weight of a synthetic resin precondensate, b) 10 to 30 percent by weight of a thermoplastic plastic with reactive groups, c) 0.1 to 1.0 percent by weight of an inorganic salt with an acidic reaction, d) 0.2 to 2.0 percent by weight of a softening agent, and e) 0.05 to 0.5 percent by weight of an emulsifier.

2. Composition according to claim 1, wherein the synthetic resin precondensate has at least two methylol groups.

3. Composition according to claim 2, wherein the methylol groups are bonded to an N-atom.

4. Composition according to claim 1, wherein the reactive groups of the thermoplastic plastic are methylol groups and carboxyl groups.

5. Composition according to claim 4, wherein the methylol group is bonded to an N-atom.

6. Composition according to claim 1, wherein the inorganic salt with an acidic reaction is magnesium chloride.

7. Composition according to claim 1, wherein the softening agent is a silicone oil, a wax or a combination thereof.

8. Composition according to claim 1, wherein the emulsifier is a nonionic emulsifier.

9. A method of using the composition according to claim 1 including the step of using the composition for finishing fibrous material for a thermal transfer printing process.

10. A process for thermal transfer printing on fibrous material, comprising the steps of:

finishing a fibrous material to be imprinted with the composition according to claim 1; and imprinting the fibrous material accompanied by crosslinking of the synthetic resin precondensate and the thermoplastic plastic with reactive groups.

11. The composition of claim 1 wherein the synthetic resin precondensate has at least two groups having the formula:

$$—CH_2—O—R$$

wherein R is $C_1$–$C_4$ alkyl.

* * * * *